United States Patent [19]

Bogatin

[11] Patent Number: 4,929,275

[45] Date of Patent: May 29, 1990

[54] MAGNETIC ALLOY COMPOSITIONS AND PERMANENT MAGNETS

[75] Inventor: Yakov Bogatin, Philadelphia, Pa.

[73] Assignee: SPS Technologies, Inc., Newtown, Pa.

[21] Appl. No.: 357,845

[22] Filed: May 30, 1989

[51] Int. Cl.[5] ..... B22F 1/00

[52] U.S. Cl. ..... 75/246; 75/245; 148/301; 148/401; 148/306; 148/312; 148/313; 148/314; 420/1; 420/2; 420/4

[58] Field of Search ..... 75/246, 245; 148/401, 148/301, 306, 312, 313, 314; 420/2, 1, 4

[56] References Cited

U.S. PATENT DOCUMENTS

| | | | |
|---|---|---|---|
| Re. 31,317 | 7/1983 | Fmaizumi et al. | 148/103 |
| 3,370,940 | 2/1968 | Josso | 75/122.5 |
| 4,496,395 | 1/1985 | Croat | 75/123 E |
| 4,597,938 | 7/1986 | Matsuura et al. | 419/23 |
| 4,601,875 | 7/1986 | Yamamoto et al. | 419/23 |
| 4,684,406 | 8/1987 | Matsuura et al. | 75/244 |
| 4,786,319 | 11/1988 | Zeringer | 75/10.62 |
| 4,802,931 | 2/1989 | Croat | 148/302 |
| 4,840,684 | 6/1989 | Fujimura et al. | 148/302 |

FOREIGN PATENT DOCUMENTS 0142934 6/1988 European Pat. Off. .

OTHER PUBLICATIONS

"5f Magnetism in (U, Th)CoSn", by Sechovsky et al., *J. Appl. Phys.*, vol. 63, No. 8, pp. 3070–3072, (1988).

"Chemical Bonding and Magnetism in 3d–5f Intermetallics", by Brooks et al., *J. Phys. F: Met. Phys.*, vol. 18, No. 3, pp. L33–L39 (1988).

"Influence of Hydrogen on the Magnetic Properties of the U–Co System", by Andreev et al., *Phys. Status Solidi* (a), vol. 98, No. 1, pp. K47–K51 (1986).

"Structural Chemistry and Magnetic Behavior of Ternary Uranium Gallides U(Fe, Co, Ni, Ru, Rh, Pd, Os, Ir, Pt)$Ga_5$", by Grin et al., *J. Less-Common Met.*, vol. 121, pp. 497–505 (1985).

"Low Temperature Specific Heat Measurements of $UNi_2$", by Schmitzer et al., *Physica B&C*, vol. 130B+C, No. 1–3, pp. 237–239 (1985).

Dialog Information Services Abstract Search, dated Sep. 6, 1989, 6 pages.

Dialog Information Services Abstract Search, dated Jan. 9, 1989, 18 pages.

"Industrial Uses of Depleted Uranium", by Paul Loewenstein, Reprinted from Metals Handbook, 1980.

*Primary Examiner*—Stephen J. Lechert, Jr.
*Assistant Examiner*—Nina Bhat
*Attorney, Agent, or Firm*—James D. Dee; Aaron Nerenberg

[57] ABSTRACT

This invention relates to novel permanent magnet alloy compositions and high energy permanent magnets comprising from about 0.5 to about 27 atomic percent R wherein R is at least one rare earth element including Y and Sc, from about 0.1 to about 53 atomic percent A wherein A is at least one actinide element, and the balance being at least one metal wherein at least about 50 weight percent of the balance is at least one metal selected from the group consisting of Fe, Co, Ni, and Mn. Preferably, R is from about 12 to about 18 atomic percent and R is a rare earth element selected from the group consisting of Sm, Nd, Pr, and Dy. It is also preferred that A is from about 1.5 to about 5.1 atomic percent and A is an actinide element selected from the group consisting of Ac, Th, Pa and U. The balance is preferably at least about 90 weight percent of Fe and/or Co, and further comprises from about 0.1 to about 10 weight percent of Zr and/or Cu.

39 Claims, No Drawings

MAGNETIC ALLOY COMPOSITIONS AND PERMANENT MAGNETS

BACKGROUND OF THE INVENTION

1. Field of the Invention

This invention generally relates to magnetic alloy compositions and permanent magnets and, more particularly, to magnetic alloy compositions and permanent magnets comprised of rare earth elements, actinide elements and metals.

2. Description of the Prior Art

Permanent magnets are used in a wide range of electrical equipment, such as various electrical appliances and computer devices. Advances in electronics have caused integration and miniaturization of electrical components, thereby resulting in an increasing demand for new and improved permanent magnet materials.

Known permanent magnets include alnico, hard ferrite and rare earth/cobalt magnets. Recently, permanent magnets have been introduced containing iron, various rare earth elements and boron. Known methods for producing such magnets include preparation from melt quenched ribbons and by the powder metallurgy technique of compacting and sintering. For example, U.S. Pat. No. 4,802,931, Croat, discloses an alloy with hard magnetic properties having the basic formula $RE_{1-x}(TM_{1-y}B_y)_x$ wherein RE represents one or more rare earth elements including scandium and yttrium in Group IIIA of the periodic table and the elements from atomic number 57 through 71, and TM represents a transition metal taken from the group consisting of iron or iron mixed with cobalt, or iron and small amounts of other metals such as nickel, chromium or manganese. This patent further teaches the production of these permanent magnet alloys from melt quenched material by the process generally referred to in the art as "melt spinning", which is described in U.S. Pat. No. 4,496,395. In melt spinning, the quench rate of the material can be varied by changing the linear speed of the quench surface. By selection of suitable speed ranges, products can be obtained that exhibit high intrinsic coercivity and remanence as quenched.

An example of the powder metallurgy technique is U.S. Pat. No. 4,597,938, Matsuura et al., which discloses the process for producing permanent magnet materials of the Fe-B-R type by: preparing a metallic powder having a mean particle size of 0.3–80 microns and a composition consisting essentially of, in atomic percent, 8–30% R representing at least one of the rare earth elements inclusive of Y, 2 to 28% B and the balance Fe; compacting; and sintering the resultant body at a temperature of 900°–1200° C. in a reducing or non-oxidizing atmosphere. Co up to 50 atomic percent may be present. Additional elements M (Ti, Ni, Bi, V, Nb, Ta, Cr, Mo, W, Mn, Al, Sb, Ge, Sn, Zr, Hf) may by present. The process is applicable for anisotropic and isotropic magnetic materials. Additionally, U.S. Pat. No. 4,684,406, Matsuura et al., claims a certain sintered permanent magnet material of the Fe-B-R type, which is prepared by the aforesaid process. Also, U.S. Pat. No. 4,601,875, Yamamoto et al., teaches permanent magnet materials of the Fe-B-R type produced with the additional step of subjecting the sintered bodies to heat treatment at a temperature lying between the sintering temperature and 350° C. However, none of these prior art references suggest the novel magnetic alloy compositions and permanent magnets of the present invention.

SUMMARY OF THE INVENTION

This invention relates to novel permanent magnet alloy compositions and high energy permanent magnets comprising from about 0.5 to about 27 atomic percent R wherein R is at least one rare earth element including Y and Sc, from about 0.1 to about 53 atomic percent A wherein A is at least one actinide element, and the balance being at least one metal wherein at least about 50 weight percent of the balance is at least one metal selected from the group consisting of Fe, Co, Ni, and Mn. Preferably, R is from about 12 to about 18 atomic percent and R is a rare earth element selected from the group consisting of Sm, Nd, Pr, and Dy. It is also preferred that A is from about 1.5 to about 5.1 atomic percent and A is an actinide element selected from the group consisting of Ac, Th, Pa and U. The balance is preferably at least about 90 weight percent of Fe, Co, or a combination thereof, and further comprises from about 0.1 to about 10 weight percent of Zr, Cu, or a combination thereof. Advantageously, R is Nd or Sm and A is U.

The present invention further provides novel magnetic materials which can be formed into the desired shape and practical size. Magnetic materials in accordance with the present invention can be in the form of a film, single crystal, casting, ribbon, powder, compact or sintered mass and can be produced with conventional methods known in the art. Furthermore, the invention provides novel permanent magnets having superior magnetic properties. These novel compositions and permanent magnets can be made with abundantly occurring elements.

Accordingly, it is an object of the present invention to provide novel magnetic alloy compositions and permanent magnets. It is a further object of the present invention to provide novel magnetic materials which can be formed into the desired shape and practical size. It is also an object of the present invention to provide novel permanent magnets having superior magnetic properties. It is an additional object of the present invention to provide novel magnetic alloy compositions and permanent magnets which can be made with abundantly occurring elements.

DESCRIPTION OF THE PREFERRED EMBODIMENTS

The present invention relates to a permanent magnet alloy composition and permanent magnet comprising from about 0.5 to about 27 atomic percent R wherein R is at least one rare earth element including Y and Sc, from about 0.1 to about 53 atomic percent A wherein A is at least one actinide element, and the balance being at least one metal wherein at least about 50 weight percent of the balance is at least one metal selected selected from the group consisting of Fe, Co, Ni, and Mn.

The rare earth elements R suitable for use in accordance with the present invention include both the light and heavy rare earth elements inclusive of yttrium and scandium and these elements may be used alone or in combination. More particularly, R is at least one rare earth element selected from the group consisting of La, Ce, Pr, Nd, Pm, Sm, Eu, Gd, Tb, Dy, Ho, Er, Tm, Yb, Lu, Y, and Sc. The preferred rare earth elements for use in the present invention are Sm, Nd, Pr, and Dy. Advantageously, R is Nd or Sm. However, mixtures of two or more of the rare earth elements, including mischmetal, didymium, etc., may also be utilized due to their commercial availability. These rare earth elements R cannot always be obtained as pure rare earth elements and, therefore, they may contain impurities which are entrained in the production process.

The actinide elements A used in accordance with the present invention include the elements from atomic number 89 (actinium) through atomic number 103 (lawrencium), although the elements beyond uranium have only been produced artificially. Accordingly, the preferred actinide elements A for use with this invention are Ac, Th, Pa, and U. Mixtures of these actinide elements may also be used and they may contain impurities entrained in the course of production. The most preferred actinide element A is uranium. As found in nature, uranium consists of a mixture of two isotopes, U-235 and U-238. U-235 is the naturally fissioning isotope which produces the heat and energy in nuclear power reactors. In nature, uranium contains about 0.7 weight percent U-235 with the remainder being comprised almost entirely of U-238, and the amount of U-235 is increased in the uranium to about 3 weight percent for use in many nuclear reactors. This is done in diffusion plants, also known as enrichment plants, which produce two streams of material: enriched uranium containing about 3 weight percent U-235 for use in power reactors, and depleted uranium, containing mostly U-238 with less than about 0.3 weight percent U-235. About 5 pounds of depleted uranium are produced for each pound of enriched uranium. Depleted uranium is very dense and most of its current industrial uses are based on this high density combined with abundant availability, low cost and ease of manufacture by conventional means. Also, depleted uranium has only about half the activity of natural uranium and has to be handled with care not greatly different from that needed with other heavy metals. Accordingly, depleted uranium is preferred in accordance with the present invention.

In addition to R and A, the alloy compositions and permanent magnets of the present invention contain at least one metal as the balance wherein at least about 50 weight percent of the balance is at least one metal selected from the group consisting of Fe, Co, Ni, and Mn. More particularly, the balance is at least about 50 weight percent of at least one metal selected from the group consisting of Fe, Co, Ni, and Mn and the remainder is at least one metal selected from the group consisting of Mg, Al, Si, Ti, V, Cr, Cu, Zn, Ga, Ge, Zr, Nb, Mo, Ru, Rh, Sn, Sb, Hf, Ta, W, Os, Ir, Pt, and Bi. Small amounts of other elements may be present so long as they do not materially adversely affect the practice of the invention.

A preferred compositional range is 12 to 18 atomic percent R, 1.5 to 5.1 atomic percent A, and at least about 90 weight percent of the balance being at least one metal selected from the group consisting of Fe and Co. It is also preferred that the balance further comprises from 0.1 to 10 weight percent of Zr, Cu, or a combination thereof. Advantageously, Zr is from 1 to 1.5 weight percent and Cu is from 3 to 5 weight percent of the balance.

Permanent magnet alloy compositions in accordance with the present invention can be made by mixing suitable portions of the elemental forms of the rare earth elements R, actinide elements A and metals as defined herein, and the mixtures can be melted to form alloy ingots. Moreover, magnetic materials in the form of a film, single crystal, casting, ribbon, powder, compact or sintered mass having the compositions in accordance with the present invention can be produced.

The compositions as defined herein can further provide permanent magnets which have magnetic properties as expressed in terms of a maximum energy product of at least 2 MGOe and an intrinsic coercive force of at least 1 kOe. Although lower magnetic properties are possible, a maximum energy product of at least 2 MGOe and an intrinsic coercive force of at least 1 kOe are desirable for useful permanent magnets. Preferably, the permanent magnets in accordance with this invention have a maximum energy product of at least 8 MGOe and an intrinsic coercive force of at least 14 kOe. However, it is believed that much higher magnetic energy and intrinsic coercivity are possible with this invention.

Additionally, it is believed that permanent magnets in accordance with this invention can be either anisotropic or isotropic permanent magnets, although anisotropic are preferred.

It is further believed that known methods of producing permanent magnets, including formation from melt quenched material and from compacted and sintered material, can be utilized to produce the permanent magnets in accordance with the present invention. For example, it is believed that the permanent magnets of this invention can be produced from melt quenched material by the process generally referred to in the art as "melt spinning", which is described in detail in U.S. Pat. No. 4,496,395. In melt spinning, the quench rate of the material can be varied by changing the linear speed of the quench surface. By selection of suitable speed ranges, products may be obtained that exhibit high intrinsic coercivity and remanence as quenched. Also, the permanent magnets of this invention can be produced by the powder metallurgy technique, which involves preparing a powder having a suitable composition and particle size, compacting, and sintering at a suitable temperature. An additional step of heat treatment of the sintered compact is typically utilized. Preferably, the permanent magnets of the present invention are produced by the powder metallurgy technique wherein the magnet has been sintered at a temperature between about 900° C. and 1200° C. and then further subjected to heat treatment at a temperature between about 200° C. and 1050° C. These magnets can be formed into any desired shape and size. Of course, as can be appreciated by those skilled in the art, the exact composition utilized can be adjusted depending on the method of production to maximize the magnetic properties of the permanent magnets in accordance with this invention.

Anisotropic permanent magnets can be prepared by carrying out formation in a magnetic field. Isotropic magnets can be prepared by carrying out formation in the absence of magnetic fields.

A preferred embodiment of this invention is an anisotropic permanent magnet comprising from 12 to 18 atomic percent R wherein R is at least one rare earth element selected from the group consisting of Sm, Nd, Pr, and Dy, from 1.5 to 5.1 atomic percent U, and the balance being at least one metal from the group consisting of Fe, Co, Zr, and Cu wherein at least 90 weight percent of the balance is Fe, Co or a combination of Fe and Co and the balance has 1 to 1.5 weight percent Zr and 3 to 5 weight percent Cu.

In order to more clearly illustrate this invention, the examples set forth below are presented. The following examples are included as being illustrations of the invention and should not be construed as limiting the scope thereof.

EXAMPLES

Three alloys were induction melted under a partial pressure of helium using commercially available forms of the elements with the following compositions in weight percent:

| Specimens | Zr | Cu | Fe + Co | Nd | U |
|---|---|---|---|---|---|
| 1 | 1.5 | 3 | 61.5 | 29.0 | 5 |
| 2 | 1 | 5 | 59.0 | 29.0 | 6 |
| 3 | 2 | 15 | 48.0 | 27.5 | 7.5 |

Powders and permanent magnets were then prepared from these compositions in accordance with the present invention utilizing the powder metallurgy technique of crushing the alloys to produce a powder, compacting, sintering and heat treating. The magnetic properties of specimens 1 and 2 were measured and found to be statistically equivalent when experimental error was taken into account. Average values are reported below:

| |
|---|
| Intrinsic coercive force (iHc) = 14.8 kOe |
| Residual induction (Br) = 6.8 kG |
| Maximum energy product $(BH)_{max}$ = 8.5 MGOe |

Results for specimen 3 could not be obtained since part of the sample vaporized during melting.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

What is claimed is:

1. A permanent magnet alloy composition comprising from about 0.5 to about 27 atomic percent R wherein R is at least one rare earth element including Y and Sc, from about 0.1 to about 53 atomic percent A wherein A is at least one actinide element, and the balance being at least one metal wherein at least about 50 weight percent of the balance is at least one metal selected from the group consisting of Fe, Co, Ni, and Mn.

2. The composition of claim 1 wherein R is from about 12 to about 18 atomic percent.

3. The composition of claim 1 wherein R is a rare earth element selected from the group consisting of Sm, Nd, Pr, and Dy.

4. The composition of claim 3 wherein R is Nd or Sm.

5. The composition of claim 1 wherein A is from about 1.5 to about 5.1 atomic percent.

6. The composition of claim 1 wherein A is an actinide element selected from the group consisting of Ac, Th, Pa and U.

7. The composition of claim 6 wherein A is U.

8. The composition of claim 1 wherein at least about 90 weight percent of the balance is Fe, Co, or a combination thereof.

9. The composition of claim 1 wherein the balance further comprises from about 0.1 to about 10 weight percent of Zr, Cu, or a combination thereof.

10. Magnetic material in the form of powder, compact or sintered mass having the composition as defined in claim 1.

11. Magnetic material in the form of a film, single crystal, casting or ribbon having the composition as defined in claim 1.

12. A permanent magnet comprised of from about 0.5 to about 27 atomic percent R wherein R is at least one rare earth element selected from the group consisting of La, Ce, Pr, Nd, Pm, Sm, Eu, Gd, Tb, Dy, Ho, Er, Tm, Yb, Lu, Y and Sc, from about 0.1 to about 53 atomic percent A wherein A is at least one actinide element selected from the group consisting of Ac, Th, Pa, and U, and the balance being at least about 50 weight percent of at least one metal selected from group consisting of Fe, Co, Ni, and Mn, and the remainder is at least one metal selected from the group consisting of Mg, Al, Si, Ti, V, Cr, Cu, Zn, Ga, Ge, Zr, Nb, Mo, Ru, Rh, Sn, Sb, Hf, Ta, W, Os, Ir, Pt, and Bi.

13. The permanent magnet of claim 12 wherein R is from 12 to 18 atomic percent.

14. The permanent magnet of claim 12 wherein R is a rare earth element selected from the group consisting of Sm, Nd, Pr, and Dy.

15. The permanent magnet of claim 14 wherein R is Nd or Sm.

16. The permanent magnet of claim 12 wherein A is from 1.5 to 5.1 atomic percent.

17. The permanent magnet of claim 12 wherein A is U.

18. The permanent magnet of claim 17 wherein A is depleted uranium.

19. The permanent magnet of claim 12 wherein at least 90 weight percent of the balance is Fe, Co, or a combination thereof.

20. The permanent magnet of claim 12 wherein the balance further comprises from 0.1 to 10 weight percent of Zr, Cu, or a combination thereof.

21. The permanent magnet of claim 20 wherein Zr is from 1 to 1.5 weight percent and Cu is from 3 to 5 weight percent.

22. The permanent magnet of claim 12, wherein the magnet is anisotropic.

23. The permanent magnet of claim 12, wherein the magnet has a maximum energy product of at least 2 MGOe.

24. The permanent magnet of claim 23, wherein the magnet has a maximum energy product of at least 8 MGOe.

25. The permanent magnet of claim 12, wherein the magnet has an intrinsic coercive force of at least 1 kOe.

26. The permanent magnet of claim 25, wherein the magnet has an intrinsic coercive force of at least 14 kOe.

27. The permanent magnet of claim 12, wherein the magnet has been formed from compacted and sintered material.

28. The permanent magnet of claim 27, wherein the magnet has been sintered at a temperature from 900° C. to 1200° C. inclusive.

29. The permanent magnet of claim 27, wherein the magnet has been further subjected to heat treatment at a temperature between from 200° C. to 1050° C. inclusive.

30. The permanent magnet of claim 12, wherein the magnet has been formed from melt quenched material.

31. Anisotropic permanent magnet comprising from 12 to 18 atomic percent R wherein R is at least one rare earth element selected from the group consisting of Sm, Nd, Pr, and Dy, from 1.5 to 5.1 atomic percent U, and the balance being at least one metal selected from the group consisting of Fe, Co, Zr, and Cu, wherein at least 90 weight percent of the balance is Fe, Co or a combination of Fe and Co and the balance has 1 to 1.5 weight percent Zr and 3 to 5 weight percent Cu.

32. The permanent magnet of claim 31, wherein R is Nd.

33. The permanent magnet of claim 31, wherein R is Sm.

34. The permanent magnet of claim 31, wherein U is depleted uranium.

35. The permanent magnet of claim 31, wherein the magnet has a maximum energy product of at least 2 MGOe.

36. The permanent magnet of claim 35, wherein the magnet has a maximum energy product of at least 8 MGOe.

37. The permanent magnet of claim 31, wherein the magnet has an intrinsic coercive force of at least 1 kOe.

38. The permanent magnet of claim 37, wherein the magnet has an intrinsic coercive force of at least 14 kOe.

39. A process for making a permanent magnet which comprises: providing material having an overall composition comprising from about 0.5 to about 27 atomic percent R wherein R is at least one rare earth element including Y and Sc, from about 0.1 to about 53 atomic percent A wherein A is at least one actinide element, and the balance being at least one metal wherein at least about 50 weight percent of the balance is at least one metal selected from the group consisting of Fe, Co, Ni, and Mn; and forming said material into an alloy body having magnetic properties.

* * * * *